US012172809B1

(12) United States Patent
Feemster

(10) Patent No.: US 12,172,809 B1
(45) Date of Patent: Dec. 24, 2024

(54) INTEGRATED DISPOSABLE CUP LID AND COVER

(71) Applicant: Jertonya Feemster, Frisco, TX (US)

(72) Inventor: Jertonya Feemster, Frisco, TX (US)

( * ) Notice: Subject to any disclaimer, the term of this patent is extended or adjusted under 35 U.S.C. 154(b) by 0 days.

(21) Appl. No.: 17/671,918

(22) Filed: Feb. 15, 2022

(51) Int. Cl.
*B65D 51/18* (2006.01)
*B65D 43/02* (2006.01)

(52) U.S. Cl.
CPC ..... *B65D 51/18* (2013.01); *B65D 43/0212* (2013.01); *B65D 2251/0018* (2013.01); *B65D 2251/0081* (2013.01); *B65D 2543/00027* (2013.01); *B65D 2543/00046* (2013.01); *B65D 2543/00527* (2013.01); *B65D 2543/00537* (2013.01); *B65D 2543/00759* (2013.01); *B65D 2543/00796* (2013.01)

(58) Field of Classification Search
CPC ..... B65D 51/18; B65D 43/0212; B65D 2251/04; B65D 2251/0018
See application file for complete search history.

(56) References Cited

U.S. PATENT DOCUMENTS 4,487,114 A * 12/1984 Abdenour ..... A47J 31/02 99/308
4,705,172 A * 11/1987 Gage ..... B65D 43/0212 220/781
5,477,979 A * 12/1995 Goessling ..... A47G 19/2272 220/259.3
5,692,617 A * 12/1997 Adams ..... B65D 21/0231 206/508
5,775,205 A * 7/1998 Melton ..... A47J 31/06 99/279
7,264,135 B2 * 9/2007 Savicki ..... B65D 43/0208 206/509
2008/0029427 A1 * 2/2008 Anderson ..... B65D 1/36 206/562
2010/0320220 A1 * 12/2010 Hussey ..... B65D 51/18 220/796
2018/0127163 A1 * 5/2018 Choi ..... B65D 47/0857

* cited by examiner

*Primary Examiner* — Jeffrey R Allen
(74) *Attorney, Agent, or Firm* — Law Office of Sam Sokhansanj PLLC

(57) ABSTRACT

An integrated cover and lid for a disposable cup such that the cover can protect the lid and its mouthpiece from coming into contact with another person's hands and corresponding germs, bacteria, viruses, dirt, debris, and other particles. In particular, the disposable cup cover and lid system can include a round cover having a first diameter, wherein the cover includes a round projection having a second diameter less than the first diameter. The cover and lid system can further include a lid having a third diameter, wherein the lid includes a basin region having a fourth diameter less than the third diameter, wherein the round projection of the cover is received within the basin region of the lid. Here, the basin region of the lid can further include a plurality of protrusions around its perimeter, wherein the plurality of protrusions engage an outer perimeter wall of the round projection.

10 Claims, 7 Drawing Sheets

INTEGRATED DISPOSABLE CUP LID AND COVER

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Restaurants and coffee shops typically serve coffee, tea, and other beverages to customers with a disposable cup, which often has a disposable lid, covering the cup in which the coffee is being served. Some types of lids for these coffee cups have an opening at the perimeter of the lid which permits the person to drink the coffee or beverage while leaving the lid in place in its closing position. When the coffee cup is being handled or passed from one person to another, the lid (including the mouthpiece) can come into contact with another person's hand whereby germs, bacteria, and viruses can be easily spread onto the lid and mouthpiece. Moreover, the exposed lid itself (including the mouthpiece) is susceptible to particles in the air, such as airborne bacteria, viruses, and residue from another person's sneeze or cough. Hence, the use of conventional disposable lids are highly unsanitary.

Hence, what is needed is an integrated cover for a disposable lid of a disposable cup, such that the integrated cover can protect the entire lid and the mouthpiece from coming into contact with another person's hands and corresponding germs, bacteria, viruses, dirt, debris, and other particles.

BRIEF SUMMARY

In one aspect of the disclosure described herein, an integrated cover for a disposable lid of a disposable cup is disclosed, such that the integrated cover can protect the entire lid and the mouthpiece from coming into contact with another person's hands and corresponding germs, bacteria, viruses, dirt, debris, and other particles. In addition, the integrated cover can be secured held onto the lid and also be easily removed via a release tab.

In another aspect of the disclosure described herein, a disposable cup cover and lid system is disclosed having a round cover having a first diameter, wherein the cover includes a round projection having a second diameter less than the first diameter. The cup cover and lid system can further include a lid having a third diameter, wherein the lid includes a basin region having a fourth diameter less than the third diameter, wherein the round projection of the cover is received within the basin region of the lid. Here, the basin region of the lid can further include a plurality of protrusions around its perimeter, wherein the plurality of protrusions engage an outer perimeter wall of the round projection. In addition, the basin region further comprises a plurality of indentations between each of the protrusions. Here, the cover may also include a tab for releasing the cover from the lid.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
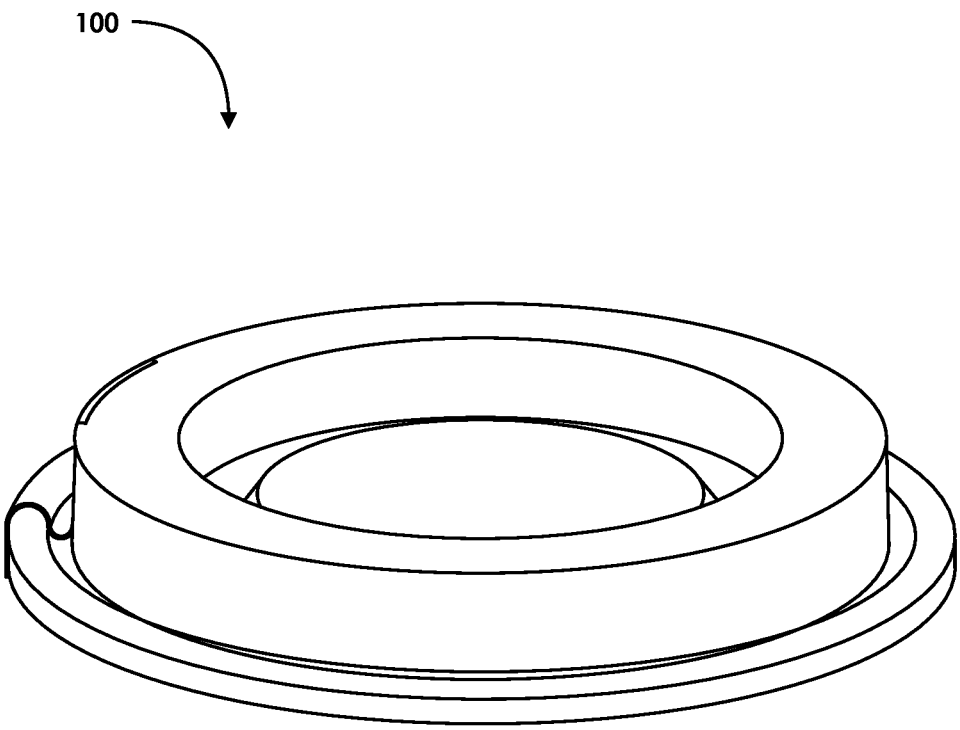
FIG. 1 illustrates a perspective view for one non-limiting exemplary embodiment of a disposable cover of the disclosure described herein.
Figure 2:
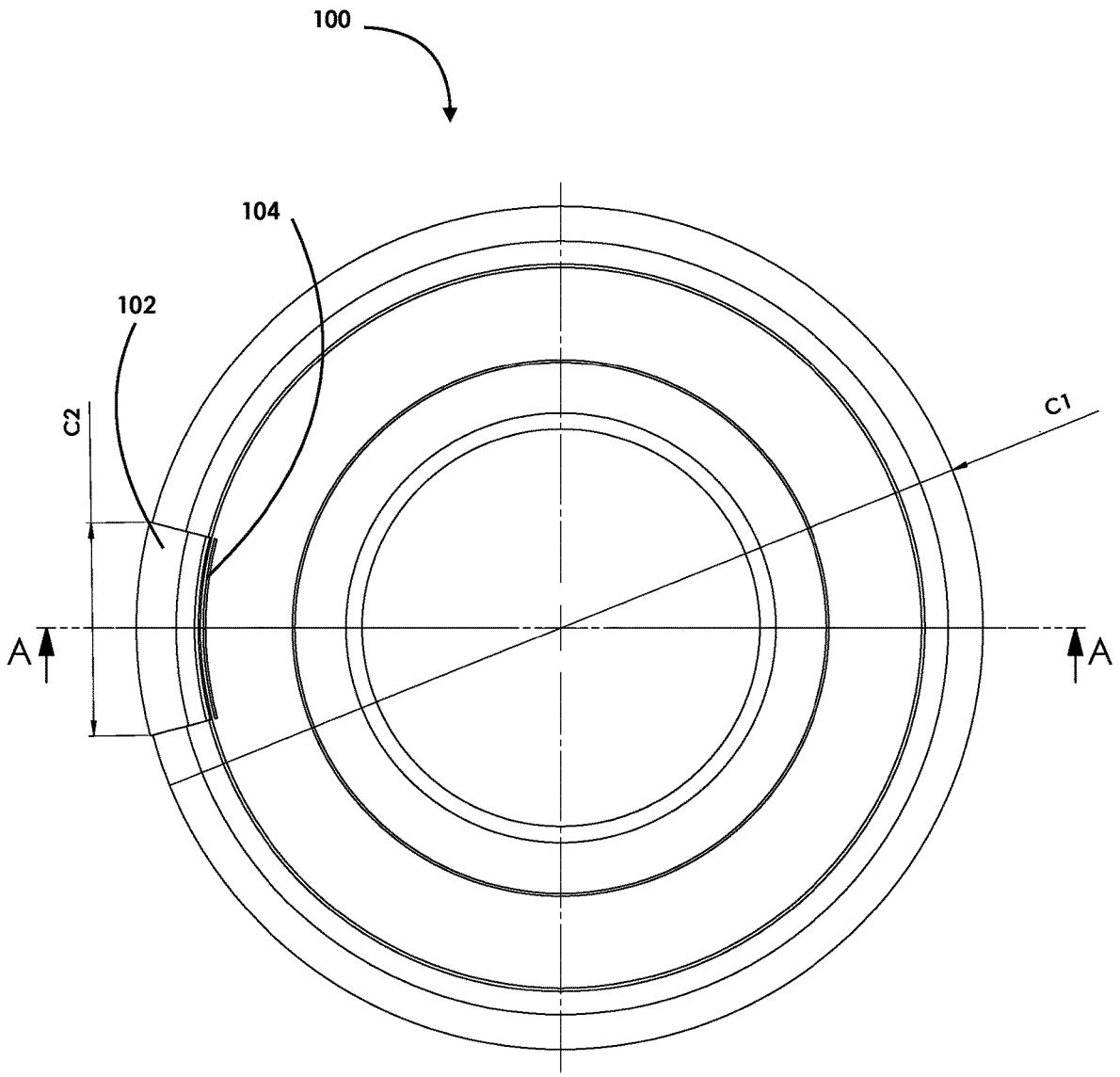
FIG. 2 illustrates a top view for the disposable cover of FIG. 1.
Figure 3A:
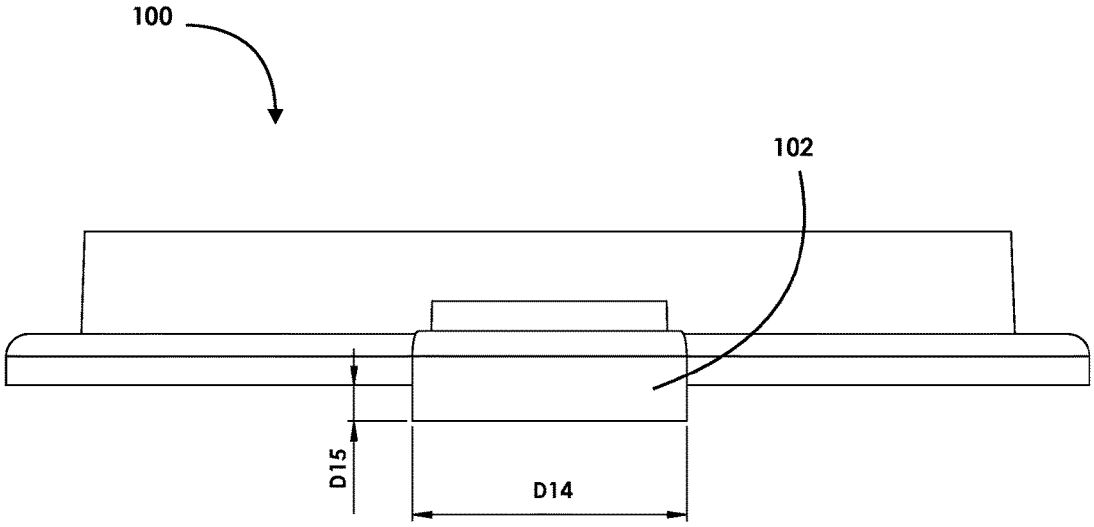
FIG. 3A illustrates a front view for the disposable cover of FIG. 1.

FIGS. 1-3 illustrates one non-limiting embodiment of a disposable cover 100 for a disposable lid 200 of the disclosure described herein. Here, cover 100 is generally adapted to securely and snugly fit on top of lid 200, and further be easily removed from lid 200, such as when the user is prepared to consume a beverage from using the mouthpiece opening of lid 200. Here, cover 100 is configured such that it includes a pull or release tab 102 secured to cover 100. In particular tab 102 can pivot or partially rotate via hinge 104 or about axis 104. In one embodiment, tab 102 may rotate or pivot independent of cover 100, or in another embodiment, tab 102 can rotate or pivot with cover 100. In particular, tab 102 can be either an independent separate piece that is mounted or secured to the body of cover 100, or extruded or injection molded to be part of (as a unitary component) of the body of cover 100. In operation, while cover 100 is securely mounted on top of lid 200, a user can place his or her finger underneath region 106 and gently push or pull tab 102 upwards and/or outwards away from lid 200, such that cover 100 can be released and removed from lid 200. In particular, the pushing and/or pulling of tab 102 slightly flexes the structural body of cover 100, such that cover 100 no longer has a secure tight fit with the top of lid 200, thereby allowing cover 100 to be released and removed.

Figure 3B:
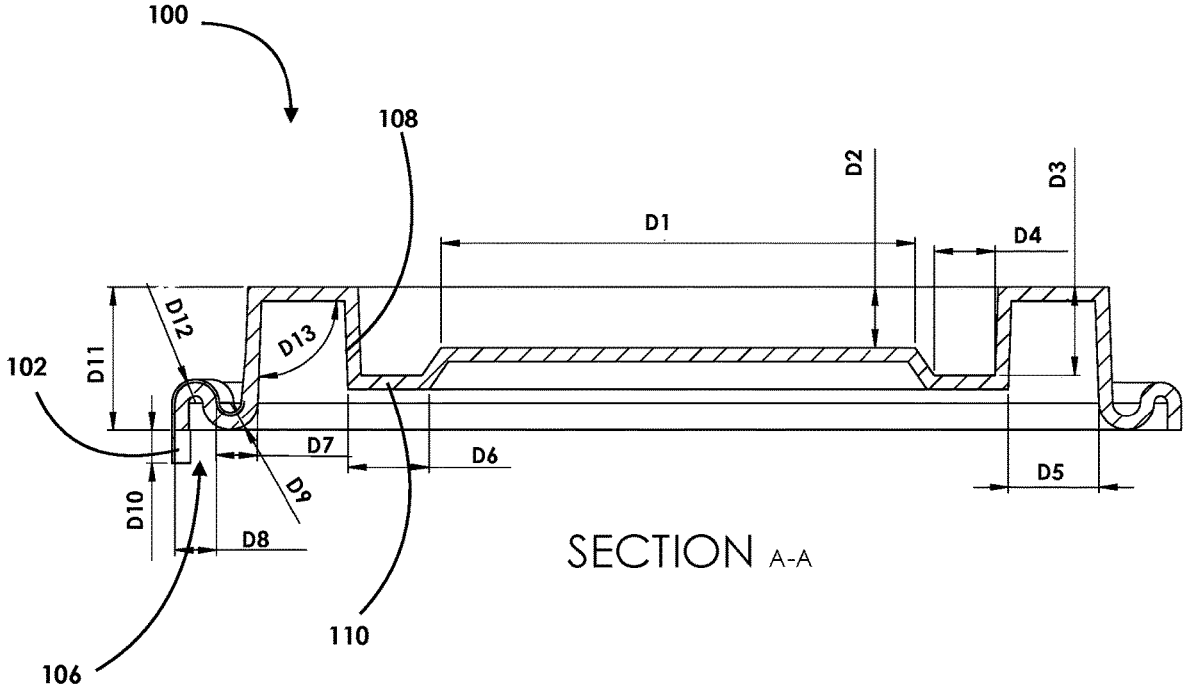
FIG. 3B illustrates a cross-sectional side view for the disposable cover of FIG. 1.

Referring to FIGS. 2-3B, the following are preferred measurements with respect to reference numerals C1-C2 and D1-D15. Here, each of the following values for C1-C2 and D1-15 are considered to be approximations, namely, C1 diameter is about 3.65 in., C2 is about 0.92 in., D1 diameter is about 1.72 in., D2 is about 0.22 in., D3 is about 0.32 in., D4 is about 0.22 in., D5 is about 0.33 in., D6 is about 0.29 in., D7 is about 0.15 in., D8 is about 0.15 in., D9 radius is about 0.10 in., D10 is about 0.12 in., D11 is about 0.52 in., D12 radius is about 0.08 in., D13 is about 92-degrees, D14 is about 0.93 in., and D15 is about 0.12 in.

Figure 4:
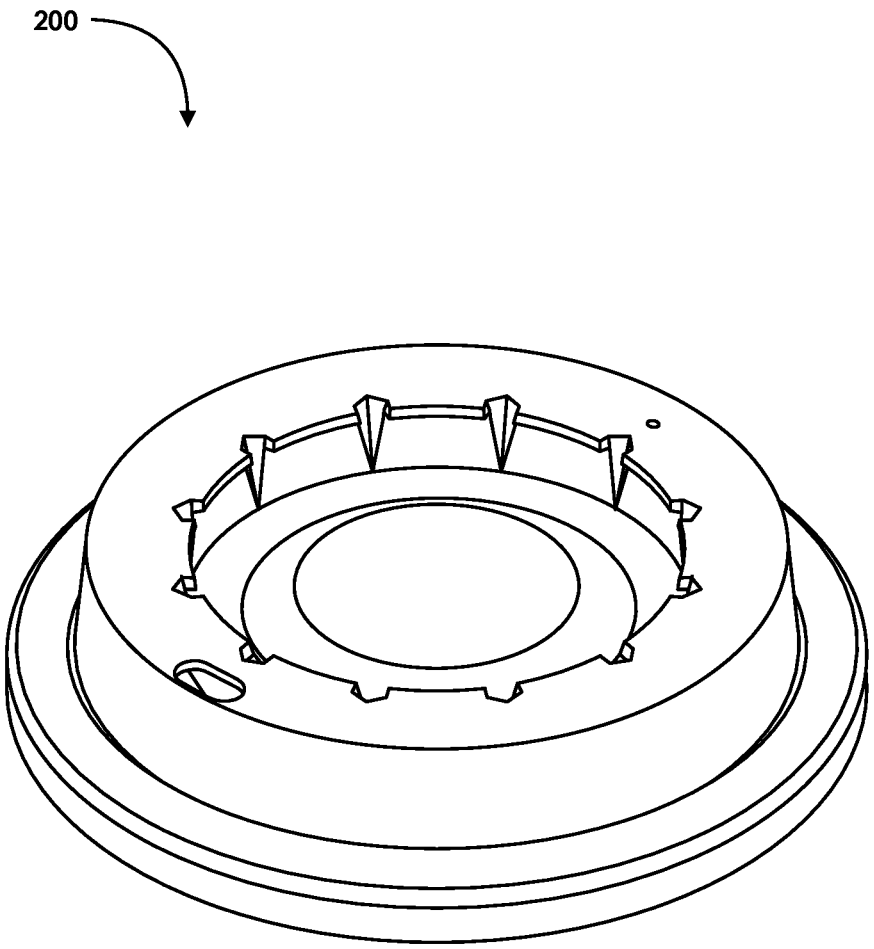
FIG. 4 illustrates a perspective view for one non-limiting exemplary embodiment of a disposable lid of the disclosure described herein.
Figure 5:
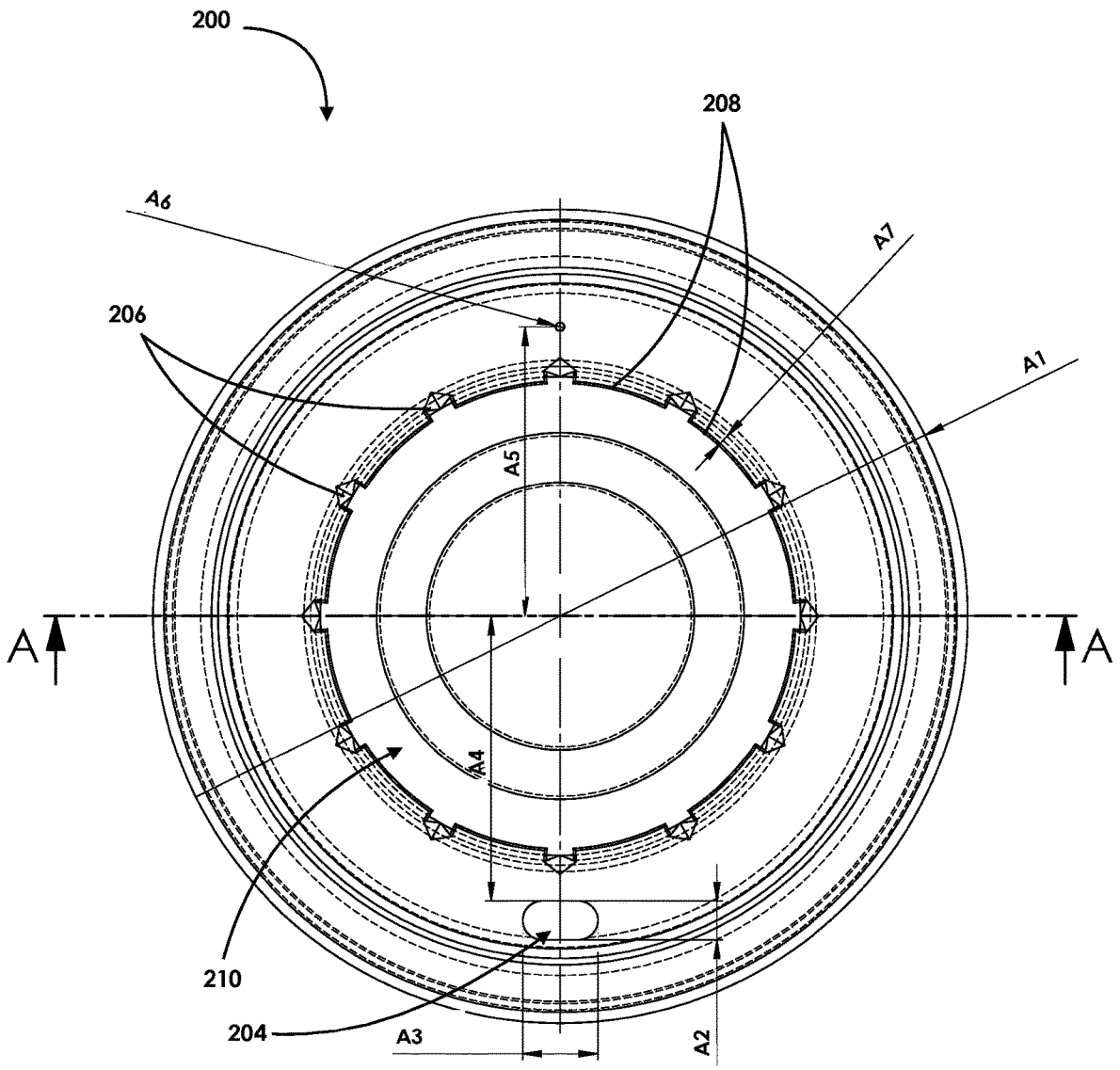
FIG. 5 illustrates a top view for the disposable lid of FIG. 4.
Figure 6:
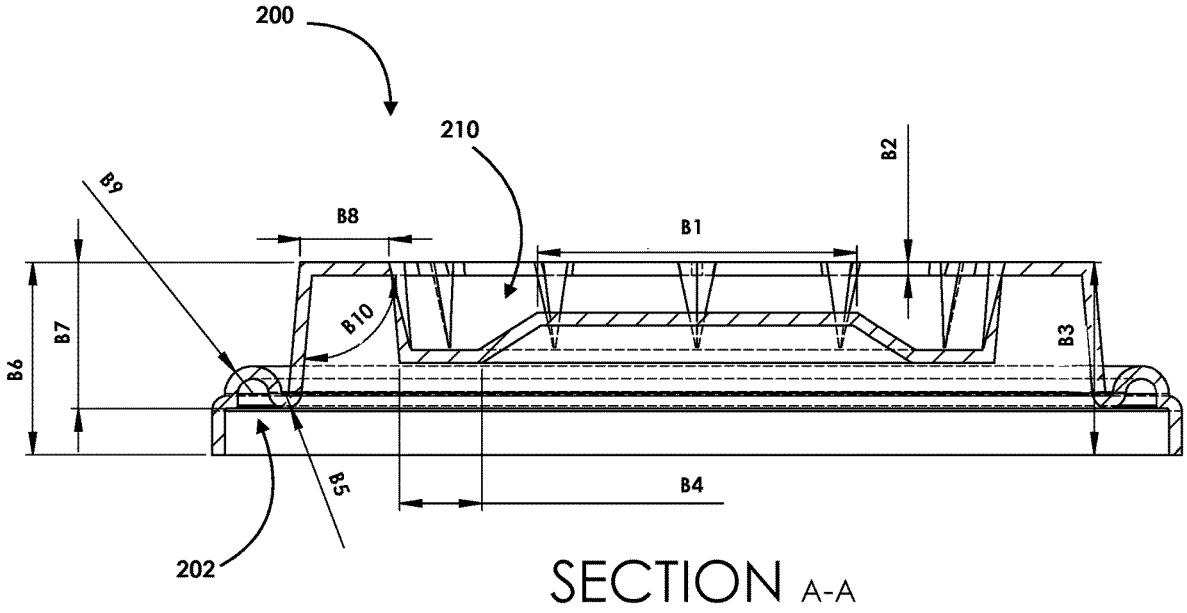
FIG. 6 illustrates a cross-sectional side view for the disposable lid of FIG. 4.

FIGS. 4-6 illustrate one non-limiting embodiment of the disposable lid 200 for the disposable cover 100 of the disclosure described herein. Here, lid 200 is generally adapted to securely receive cover 100, and further allow lid cover 100 to be easily removed. In addition, lid 100 can also be attached and removed from a disposable cup. Here, lid 100 generally includes an inner lip region or channel 202 that allows lid 100 to be securely fit onto an outer lip or ring of any size container or disposable cup. In addition, lid 100 also includes a mouthpiece opening 204 for dispensing a liquid beverage out from a cup. Further, lid 100 generally includes a plurality of protrusions or projections 208 that are equally spaced apart from each other around the perimeter of the indented, basin, or impression region 210 of lid 100. In particular, each protrusion is created via a plurality of trapezoidal or triangular type fillets or indentations 206. Here, indentations 206 allows each projection 208 to project outwards, but also allow each projection 208 to be flexible and move independently relative to adjacent or opposing projections 208. Specifically, each indentation 206 creates a space or gap between each projection 208. In operation, once cover 100 is mounted on top of lid 200, the outer perimeter wall or surface 108 of cover 100 is configured to directly abut against protrusions 208 of lid 200, thereby creating a snug and secure tight friction fit or surface tension. In particular, the circular projection 110 of cover 100 is configured to be received within the impression or basin region 210 of lid 200 (FIG. 6). Similarly, when tab 102 of cover 100 is pulled, pushed, or released, it also partially releases the surface tension or friction fit between outer perimeter wall 108 and the outer surface of projections 208, thereby allowing cover 100 to be released and removed from lid 100.

Referring to FIGS. 5-6, the following are preferred measurements with respect to reference numerals A1-A7 and B1-B10. Here, each of the following values for A1-A2 and B1-B10 are considered to be approximations, namely, A1 diameter is about 3.77 in., A2 is about 0.18 in., A3 is about 0.35 in., A4 is about 1.32 in., A5 is about 1.34 in., A6 through hole diameter is about 0.04 in., A7 is about 0.05 in., B1 diameter is about 1.24 in., B2 is about 0.05 in., B3 is about 0.75 in, B4 is about 0.32 in., B5 radius is about 0.07 in., B6 is about 0.75 in., B7 is about 0.57 in., B8 is about 0.34 in., B9 radius is about 0.11 in., and B10 is about 95-degrees.

Figure 7A:
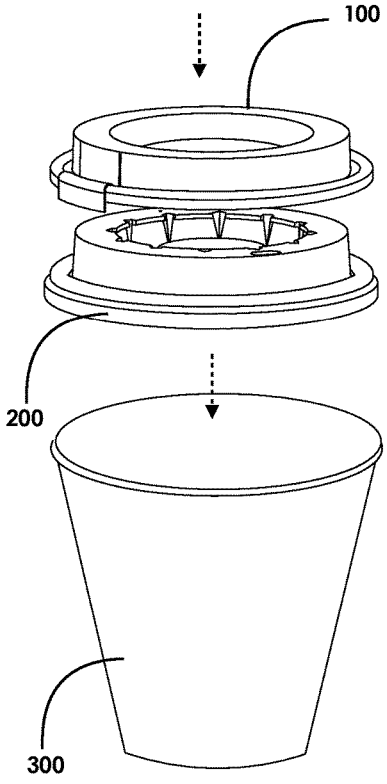
FIGS. 7A-7C illustrate perspective views of the disposable cover and lid and a method of assembling and removing the disposable cover and lid of the disclosure described herein.
Figure 7B:
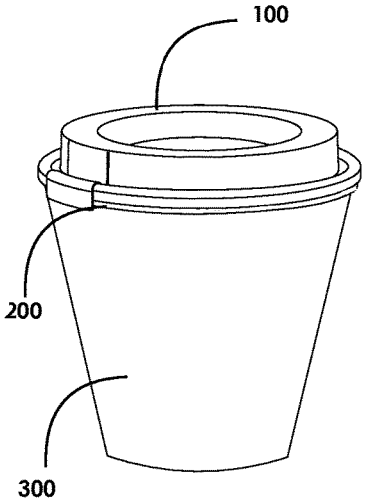
Figure 7C:
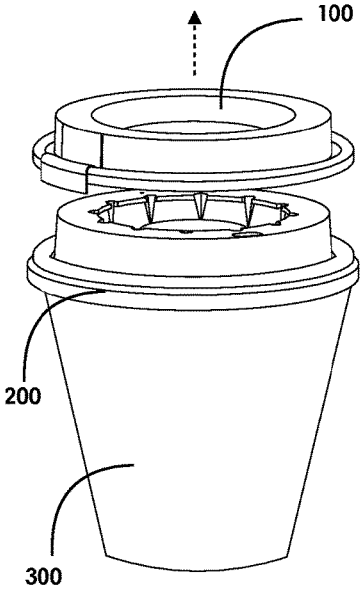

FIGS. 7A-7C illustrate one non-limiting exemplary embodiment of assembly, attaching, and removing cover 100 and lid 200 onto and from a cup 300. FIG. 7A illustrates attaching cover 100 to lid 200 and lid 200 to cup 300. FIG. 7B illustrates cover 100 secured to lid 200 and the cup 300. Here, in one embodiment, the outer lip of cover 100 can extend downwards to cover the outer lip of lid 200. FIG. 7C illustrates the process of removing cover 100 from lid 200, wherein lid 200 remains secured to cup 300. Here, cover 100 and lid 200 can be pre-packaged together as one combined unit or cover and lid system, wherein cover 100 and lid 200 (such as shown in FIG. 7B) are previously secured to each other and the combined cover and lid and secured to the cup after liquids are poured into the cup and served. Such pre-packaged combined cover/lid units or systems of cover 100 and lid 200 can be stacked on top of each other and further sold or provided as a package, such as a package of 50, 100, 500, or 1000 stacked units, among others. In particular, a person (such as a server or barista) can simply just connect and attach the combined lid 200 and cover 100 (as one unit) to a container or disposable cup 300 without having to touch or come into direct contact with lid 200, and more specifically, with the mouthpiece of lid 200 or in and around the mouthpiece. In addition, in such a combined lid and cover scenario, the outer surface of lid is not exposed to outer environmental elements, such as liquids, dust, and airborne particles, among others. This allows the combined cover and lid to be attached to the cup at the time a drink or beverage is poured into cup 300 by the user, server, or barista. Once the drink or beverage cup (with the combined lid and cover) is served to a user, and the user is prepared to consume the beverage, then he or she can simply remove cover 100 from lid 200 while lid 200 remains secured to cup 300. In addition, the lid 200 can also operate to prevent spillage from the lid, such as liquids coming out of the mouthpiece opening of lid 200, such as further when holding the cub with liquids contained therein during walking, running, or the cup falling over on its side.

It is contemplated within the scope of the disclosure described herein that any of cover 100 and lid 200 may be made of any material, such as plastic, recycled plastic, paper-based, aluminum, metal, or any other type of polymer-based material. In addition, cover 100 and lid 200 may each have varying thicknesses, wherein cover 100 is thinner than lid 200. Alternatively, each cover 100 and lid 200 may have the same or substantially the same thickness.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A disposable cup cover and lid system, comprising:

a round cover having a first shaped structure, the first shaped structure of the round cover comprising a first flat radial surface, wherein the first flat radial surface is followed by a second flat radial surface and the second flat radial surface is followed by a third flat radial surface, wherein the first flat radial surface is above the second flat radial surface, the third flat radial surface is above the second flat radial surface, the third flat surface is below the first flat radial surface, and wherein the third flat radial surface comprises a sloped radial sidewall;

a lid having a second shaped structure independent of the first shaped structure of the round cover, the second shaped structure of the lid comprising a fourth flat radial surface having an inner radial sidewall, wherein the inner radial sidewall of the fourth flat radial surface comprises a plurality of indentations in a radial pattern and curved regions having a smooth surface between each of the plurality of indentations, wherein the fourth flat radial surface is followed by a fifth flat radial surface and the fifth flat radial surface is followed by a sixth flat radial surface, wherein the fourth flat radial surface is above the fifth flat radial surface, the sixth flat radial surface is above the fifth flat radial surface, and the sixth flat radial surface is below the fourth flat radial surface, and wherein the sixth flat radial surface comprises a sloped radial sidewall such that the plurality of indentations face the sloped radial sidewall of the sixth flat radial surface; and wherein the radial sidewall of the fourth flat radial surface of the lid engages the round cover, such that the round cover is secured to the lid.

2. The disposable cup cover and lid system of claim 1, wherein the fourth flat radial surface of the lid comprises a cut-out opening.

3. The disposable cup cover and lid system of claim 1, wherein the plurality of indentations are comprised of an at least partial triangular configuration.

4. The disposable cup cover and lid system of claim 1, wherein the plurality of indentations extend downwards to the fifth flat radial surface.

5. The disposable cup cover and lid system of claim 1, wherein the cover comprises a tab.

6. A disposable cup cover and lid system, comprising:

a round cover having a first shape comprising a first flat radial surface having a first diameter a second flat raised radial surface having a second diameter, wherein the second flat raised surface comprises a first sloped radial sidewall, and wherein the second diameter of the second flat raised surface is smaller than the first diameter of the first flat radial surface;

a lid having a second shape not identical to the first shape of the round cover, wherein the second shape comprises a third flat radial surface having a third diameter a fourth flat raised radial surface having a fourth diameter, wherein the fourth flat raised radial surface comprises a second sloped radial wall independent of the first sloped radial wall, wherein the fourth diameter of the fourth flat raised surface is smaller than the third diameter of the third radial surface; and the third flat radial surface of the lid further comprising an inner sidewall having a plurality of grooves spaced-apart from each other in a radial pattern, wherein each groove comprises a sloped surface relative to a vertical plane, and wherein the plurality of indentation directly face the second sloped radial wall of the fourth flat radial surface.

7. A disposable cup cover and lid system, comprising:

a round cover comprising a first radial region with a first diameter and a second radial region comprising a first round projection having a second diameter, wherein the second diameter is less than the first diameter;

a lid independent of the round cover, wherein the lid comprises a third radial region with a third diameter and a fourth radial region comprising a second round projection having a fourth diameter, wherein the fourth diameter is less than the third diameter; and the third radial region having a shape independent of the first radial region of the round cover, the third radial region comprising a plurality of indentations spaced apart from each other in a radial pattern on an inner sidewall of the third radial region, wherein each of the plurality indentations comprise at least a first triangular shaped surface or a first partially cone-shaped surface, wherein the first triangular shaped surface or the partially cone-shaped surface are at a slope relative to a vertical plane and in an inverted configuration, and wherein the plurality of indentations directly face the fourth radial region of the lid.

8. The disposable cup cover and lid system of claim 7, wherein the round cover further comprises a tab secured thereto.

9. The disposable cup cover and lid system of claim 8, wherein the tab is secured to an outer sidewall of the first radial region.

10. The disposable cup cover and lid system of claim 7, wherein the second radial region and the fourth radial region each comprised a sloped sidewall.

* * * * *